United States Patent [19]

Sawada et al.

[11] 4,323,404

[45] Apr. 6, 1982

[54] METHOD FOR PROVIDING SINGLE PIECE WITH PLURAL DIFFERENT MECHANICAL CHARACTERISTICS

[75] Inventors: Susumu Sawada, Muroran; Takashi Fukuda, Noboribetsu; Katsuhiro Tsuchiya, Muroran; Kazuo Ito, Noboribetsu, all of Japan

[73] Assignee: The Japan Steel Works Ltd., Tokyo, Japan

[21] Appl. No.: 147,453

[22] Filed: May 7, 1980

[51] Int. Cl.[3] ..... C21D 1/78

[52] U.S. Cl. ..... 148/148; 148/39; 148/149

[58] Field of Search ..... 148/148, 149, 39

[56] References Cited

U.S. PATENT DOCUMENTS 3,578,512 5/1971 Funakubo ..... 148/149

*Primary Examiner*—R. Dean

*Attorney, Agent, or Firm*—Sughrue, Mion, Zinn, Macpeak & Seas

[57] ABSTRACT

A method for producing a single solid metal work piece having different mechanical characteristics in different sections. A groove is cut in the piece between each section. A partitioning wall is inserted in the groove with the remainder of the groove filled with insulating material. Different sections are heated to different quenching temperatures then cooled at the same or different rates. For example, one section may be cooled by water spraying while another is cooled by air blast.

4 Claims, 3 Drawing Figures

METHOD FOR PROVIDING SINGLE PIECE WITH PLURAL DIFFERENT MECHANICAL CHARACTERISTICS

BACKGROUND OF THE INVENTION

The present invention relates to a heat treatment method for providing different mechanical characteristics for a single treated piece.

When different parts of a single piece must have different mechanical or metallurgical characteristics, in accordance with the most widely used prior art technique, after a plurality of materials each having different chemical characteristics are independently heat-treated, the treated materials are rigidly coupled to each other by welding or the like. Exceptionally, there have been some conventional methods using only heat treatments to satisfy the above described requirement. For example, in one of these methods, local quenching is employed with which one side of a piece requiring hardness and strength is heated up to a preferred quenching temperature and thereafter water-quenched. Such a quenching method is the same as the more generally used quenching methods except that here only one side of the piece is quenched. However, the parts to which the heat treatment is not applied may have undesirable mechanical characteristics in comparison with the quenched parts, and the heat treated parts only be needed to be used in the site. Therefore, overall products produced using this method often cannot be used under severe circumstances.

A method has also been heretofore used with which tempering rather than quenching has been used to somewhat change mechanical strength locally. Temperatures are changed locally for the tempering procedure. However, since metallugical characteristics of steel mainly depend on the heating temperature used in quenching and the cooling speed employed and as tempering generally involves the use of smaller temperature changes, the mechanical strength of parts so treated are only slightly changed, that is, the metallurgical characteristics of each part cannot be greatly changed.

There have been some requirements that high strength at a raised temperature be imparted to one part of a product while at the same time low temperature toughness be provided to the other part of the same product, the two characteristics being metallugically quite contrary to each other. It has heretofore not been possible to satisfy such requirements as there has been no method available to solve the problem by using heat treatment alone.

SUMMARY OF THE INVENTION

Accordingly, an object of the present invention is to provide a heat treatment procedure for imparting locally different characteristics to a single piece.

This and other objects of the present invention are achieved by providing a method including the steps of dividing the piece to be heat treated into plural sections by at least one groove whose surface is processed, heating each section to different quenching temperatures and thereafter cooling each section at different or the same cooling speeds to thereby impart different mechanical characteristics to the respective sections.

BRIEF DESCRIPTIONS OF THE DRAWINGS

DESCRIPTION OF THE PREFERRED EMBODIMENTS

The present invention will be hereinafter described with reference to the accompanying drawings.

Figure 1:
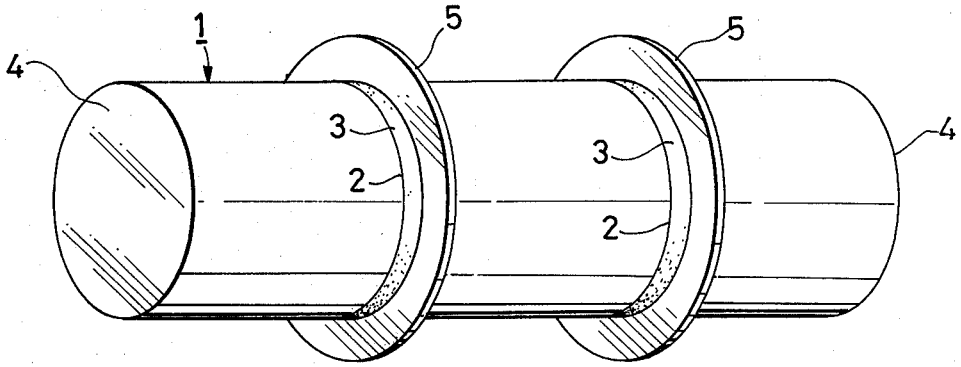
FIG. 1 is a side view of a rod-shaped work piece showing positional relationships among grooves formed in the piece and partitioning walls according to the present invention.

At least one groove 2 which is filled with a heat insulating material 3 is formed in a rod-shaped piece to be quenched. In the specific embodiment shown in FIG. 1, two grooves 2 are formed in the rod-shaped piece which is heated so that the section between the two grooves 2 and the part between the groove 2 and an end surface 4 are heated to different temperatures and so that, by the provision of two partitioning walls 5, each section may be separately or independently cooled during the quenching operation. For example, when cooling the section between the grooves 2 by water spraying and the section between the grooves 2 and the end surface 4 by air blast, it is possible to prevent the application of sprayed water to the adjacent non-intended section.

The heat treatment according to the present invention will be described with reference to a preferred example. Since high pressure turbine shafts used in electric generators require high-temperature strength, the shafts have hitherto been produced with a combination of materials having suitable metallurgical and chemical characteristics and processed with a quenching technique using relatively high quenching temperatures and low cooling speeds. On the other hand, low pressure turbine shafts require high low-temperature toughness and so have been produced using combinations of materials different from those of the high-pressure turbine shafts. For low pressure turbine shafts relatively low quenching temperatures and high cooling speeds are utilized. Recently, there has been a requirement for combined high and low pressure integral turbine shafts one half of which is produced for use in a high pressure turbine and the other half produced for use in a low pressure turbine for the purpose of decreasing the cost of a power station installation in which it is used and for reducing the size thereof. With a view of satisfying this requirement, a shaft using appropriate materials was assembled, processed according to the teachings of the present invention and tested.

Figure 2A:
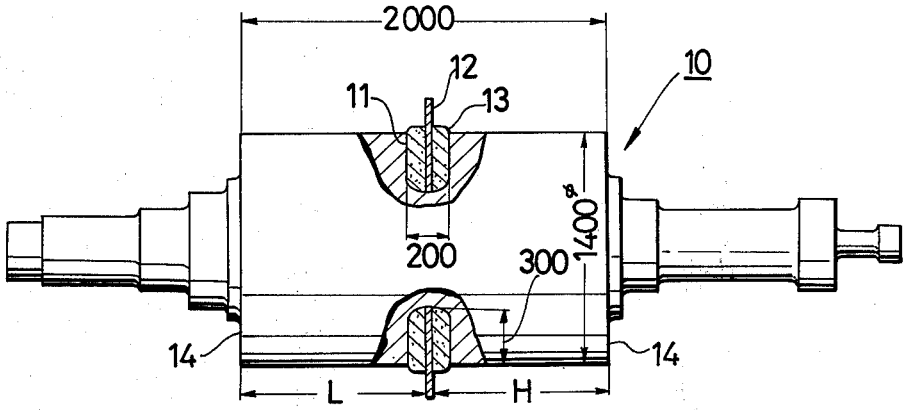
FIG. 2A is a front view partially in cross-section of a high and low pressure integral type turbine shaft produced in accordance with the present invention.
Figure 2B:
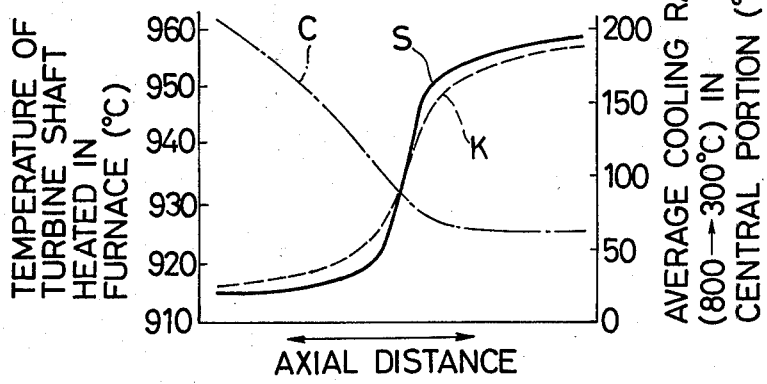
FIG. 2B is a graph, corresponding to FIG. 2A, showing temperature and cooling speed distributions of the turbine shaft shown in FIG. 2A.

FIG. 2A shows the dimensions (in millimeters) and configuration of an integrally formed high and low pressure turbine shaft 10 constructed in accordance with the present invention. The turbine shaft thereof was composed of 1% Cr, 1% Mo and 0.25% V containing steel used for conventional high pressure turbine shaft. An annular groove 11 having dimensions and configurations as shown in FIG. 2A was, in the same manner as described with respect to FIG. 1, machined and formed in the shaft material. A partitioning wall 12 was inserted in the annular groove 11 and thereafter a heat insulating material 13 was filled therein. The shaft thus assembled was disposed in an electric furnace and the section L on the low pressure side and the section H on the high pressure side were heated to temperatures of 915° C. and 960° C., respectively. After heating, the low pressure section L was treated by water spray quenching whereas the high pressure section H was cooled by air blast. During the cooling stages, the temperatures of peripheral portion and central portions of the shaft were measured. The measured temperatures are shown in FIG. 2B where S and K denote the temperatures of the peripheral and the central portions being disposed in an electric furnance, respectively, and C denotes the cooling speed. As is apparent from the graphs of FIG. 2B, it may be seen that although there was some transition region in the temperature distribution during heating in the electric furnace, a generally desirable temperature profile was obtained at a position about 500 mm from the center of annular groove 11 in either direction due to the effects of the groove 11 and the heat insulative material 13.

Also, though there was a transition region with respect to the cooling speed C of the central portion, in comparison with the high pressure section H a sufficiently high cooling speed was obtained in the low pressure section L.

Quenching and tempering according to the invention were carried out and thereafter test segments of material were taken from the high pressure section H and low pressure section L and mechanical tests were conducted. From the test results, the tensile strength of both the central portion of the high pressure section as well as the low pressure section were $\sigma_B = 80$ to 82 Kg/mm² which is substantially the same as that for the prior art high pressure turbine shaft material while the 2 mmV Charpy notch toughness of the central portion of the low pressure section was approximately FATT = +40° C. and that of the central portion of the high pressure section was approximately FATT = +100° C. which is the same as for the prior art high pressure turbine material. Creep rupture tests were conducted on the peripheral and central portions of the high pressure section H. The results show that the creep rupture strength obtained with the present invention is in the middle of the practical band of creep rupture strengths obtained in the prior art high pressure turbine shaft materials.

As described above, according to the present invention, it is possible, for example, to provide an integral high and low pressure turbine shaft material the low pressure section of which has a sufficiently high low-temperature toughness and the high pressure section of which has a satisfactory high-temperature strength. Thus, the present invention provides that treatment having marked advantages over prior art techniques.

What is claimed is:

1. A method for producing a metal piece having plural sections of different mechanical characteristics comprising the steps of: dividing a piece to be treated into plural sections by at least one groove, filling said groove with heat insulating material, forming a partitioning wall along each said groove, heating each section to a different temperature, and cooling each of said sections to thereby impart different mechanical or metallurgical characteristics to each of said sections.

2. The method of claim 1 wherein said step of cooling comprises cooling different ones of said sections at different speeds.

3. The method of claim 1 wherein said step of cooling comprises cooling different ones of said sections at substantially the same speed.

4. The method of any of claims 1 to 3 wherein said metal piece comprises a turbine shaft.

* * * * *